US006360944B1

(12) United States Patent
Gorman

(10) Patent No.: US 6,360,944 B1
(45) Date of Patent: Mar. 26, 2002

(54) FOOD CONTAINER WITH A FOLDABLE CONDIMENT HOLDER

(76) Inventor: Charles Gorman, 11260 Loch Lomond Dr., Laurinburg, NC (US) 28352

( * ) Notice: Subject to any disclaimer, the term of this patent is extended or adjusted under 35 U.S.C. 154(b) by 0 days.

(21) Appl. No.: 09/639,972

(22) Filed: Aug. 16, 2000

(51) Int. Cl.[7] ..... B65D 3/24

(52) U.S. Cl. ..... 229/400; 220/738; 229/904; 229/906

(58) Field of Search ..... 229/400, 902, 229/904, 906; 220/737, 738; 206/216, 541

(56) References Cited

U.S. PATENT DOCUMENTS

| | | | | | |
|---|---|---|---|---|---|
| 1,801,148 | A | * | 4/1931 | Gilson | 206/541 |
| 3,128,984 | A | * | 4/1964 | Palm | 220/737 |
| 3,640,380 | A | | 2/1972 | Huffman | 206/4 |
| 5,137,210 | A | * | 8/1992 | Hibbs | 229/400 |
| 5,417,364 | A | | 5/1995 | Shaw | 229/400 |
| 5,626,283 | A | * | 5/1997 | Mellon | 229/400 |
| 5,720,429 | A | | 2/1998 | Cordle | 229/120.18 |
| 5,773,801 | A | | 6/1998 | Blamer et al. | 219/727 |
| 5,775,570 | A | | 7/1998 | Kim | 229/4.5 |
| 5,842,631 | A | | 12/1998 | Berger | 229/120.13 |
| 6,152,362 | A | * | 11/2000 | Rosenfeld | 220/737 |
| 6,193,201 | B1 | * | 2/2001 | Babcock | 229/904 |
| 6,216,946 | B1 | * | 4/2001 | Cai | 229/400 |

* cited by examiner

*Primary Examiner*—Gary E. Elkins
(74) *Attorney, Agent, or Firm*—Needle & Rosenberg PC

(57) ABSTRACT

A container with a foldable holder for holding both a primary substance and a secondary substance. The container has a volume defined by a substantially upright sidewall and a bottom to receive the primary substance such as french fries therein. The container also has a lip extending from the upright sidewall upwardly. The lip has an opening and can be folded outwardly to form a holder for receiving a second container containing the secondary substance such as ketchup therein in the opening of the lip.

22 Claims, 3 Drawing Sheets

FOOD CONTAINER WITH A FOLDABLE CONDIMENT HOLDER

BACKGROUND OF THE INVENTION

1. Field of the Invention

The present invention relates generally to food and drink containers. The present invention relates more specifically to a food container with a foldable condiment holder.

2. Description of Related Art

One characteristic of American-culture is the availability of popular "fast food," or prepared foods. Most fast food restaurants, and other restaurants as well, often use disposable paperboard containers for various food products. Such food containers have several characteristics due to the economical consideration of the fast food business. First, the food container should be able to be stackable and nestable for easy shipping, handling and shelfing. Second, the food container should have capacity to hold both a primary or principal food product and a secondary food product such as a condiment or sauce so that the primary food product can be fully enjoyed by consumers. Third, the food container should be economical to make, simply to use, and easily disposable after use.

Previously known paperboard food containers with capacity to contain both primary foods and condiments typically can be divided into two groups. The first group includes food containers that have pockets or compartments to receive condiments therein. The second group includes food containers that have a fixed condiment holder to receive a separate cup having condiments therein. Either way, the condiments compartments/holders are not an integral and inherent part of the food containers. Instead, they are either separate elements mounted to the food container or complicated surface structures, which require extra care and labor to manufacture and thus increase material and manufacturing costs. Moreover, extra surface structures may negatively affect the nestability and stackability of the food containers.

Thus it can be seen that a need exists for a food container that has the capacity to hold both a primary substance and a secondary substance, which overcomes the disadvantages of previously known food containers.

SUMMARY OF THE INVENTION

The food container of the present invention provides a number of improvements over previously known containers for holding both a primary substance and a second substance, such as an associated condiment substance. For example, the container of the present invention provides a foldable condiment holder by means of a lip extending from the front panel of the food container described in greater detail below. This lip has an opening sized to receive and hold a separate, commercially available condiment cup. Because the food container is made from paperboard or similar foldable or bendable material, the lip can be easily folded from its original position wherein it is juxtaposed to the surface of the container to its operative or second position to receive therein a condiment cup. In particular, the original position is a substantially vertical position, and the operative or second position is substantially horizontal relative to the food container to receive the condiment cup. This simplified lip structure eliminates the more complicated structure of the previously known containers and thus reduces material and assembly costs, resulting in a more commercially viable product. The container of the present invention is easy and convenient for consumers to use, has an attractive shelf appearance, is nestable for ease of shipping and handling and reduced shelf space requirements, and provides large visible surface areas for the display of point-of-sale marketing features.

Briefly described, one aspect of the present invention provides a food container with a foldable holder for holding both a primary food product and a secondary food product. The food container has a substantially upright sidewall portion having a back panel, an opposing front panel cooperating with the back panel to form a cavity with two ends, with one of the ends having a bottom portion extending from the back panel to the front panel. The bottom portion has an interior face and an exterior face, where the interior face of the bottom portion closes the cavity at one end to define an interior volume for receiving a primary substance therein. It is understood that the term "cavity" encompasses any cylindrical or non-cylindrical shape or configuration. A foldable lip extends from the front panel and has an opening therethrough sized to receive a condiment container. The lip has a proximal end about which the lip is connected to the panel and foldable therealong and an opposed distal end. The opening is disposed intermediate the proximal and distal ends. When moved from its original position to its operative position, the lip forms a foldable holder for receiving a condiment container having a secondary substance therein. It is understood that the lip may be disposed anywhere on the exterior of the food container and in any location so that it is foldable about a horizontal or vertical axis. In one embodiment, the back panel has a curved top edge and is seamlessly merged with the lip along the top edge concavely from both sides of the lip. This configuration provides easy access to the interior volume of the food container.

In another aspect, the present invention provides a food container having a substantially circular sidewall forming a cavity with two ends. The sidewall has a back panel, an opposing front panel and a lip. The front panel has an opening. The lip is extending upwardly from the front panel and has an opening in communication with the opening of the front panel. The food container also has a bottom closing the cavity at one end to define a volume for receiving a primary substance therein. The lip is foldable outwardly from the sidewall to form a holder for receiving a secondary substance in the opening of the lip, which is normally contained in a second container or a condiment container. In one embodiment of the invention, the opening of the lip is substantially annular in part, and the opening of the front panel of the sidewall is substantially rectangular. The second container is partially received in the opening of the front panel of the sidewall and supported therein. Moreover, the back panel has a curved top edge having a center portion and two ends. The top edge extends from the center portion concavely to each of the two ends, thereby to provide easy access to the volume of the food container and thus the primary food conduct received therein.

In a further aspect, the present invention provides a food container having a lower portion and an upper portion. The lower portion has a bottom, a body formed by at least one substantially upright sidewall, and a mouth. The upper portion has a lip extending upwardly from the mouth of the lower portion, and an opposite back panel extending upwarding from the mouth of the lower portion, wherein the back panel cooperates with the body and bottom of the lower portion to define a volume for receiving a primary substance therein. The lip has an opening and is foldable outwardly from its original position wherein it is juxtaposed to the surface of the upper portion to its operative or second position to form a holder for receiving a secondary substance in the opening of the lip. In one embodiment of the present invention, the volume for receiving a primary substance is substantially annular cross-sectionally. In another embodiment, the volume for receiving a primary substance is substantially quadrilateral cross-sectionally.

These and other features and advantages of preferred forms of the present invention are described herein with reference to the drawing figures.

BRIEF DESCRIPTION OF THE DRAWING FIGURES

DETAILED DESCRIPTION

Figure 3:
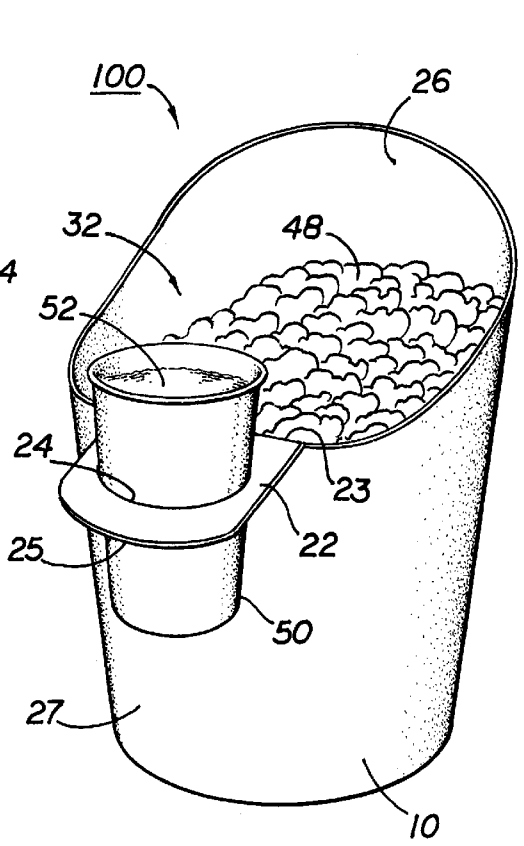
FIG. 3 is a perspective view of the container of the present invention shown in FIGS. 1 and 2 with the lip in its operative or second position to receive a condiment container therein, along with food product in the container.

Referring now to the drawing figures, wherein like reference numerals represent like parts throughout, unless otherwise specifically identified, forms of the present invention will now be described. In a first example embodiment, described with reference to FIGS. 1–3, in particular to FIG. 3, the present invention is related to a food container 100 for holding a primary substance such as a food product 48. The food container 100 has a foldable holder 22 by means of a lip for receiving and holding a secondary substance 52. The food product 48 may be, for example, french fries, cheese sticks, onion rings, chicken wings or other food products. The container of the present invention is particularly well-suited for, but is not limited to, holding finger foods that need a secondary substance such as a condiment product 52 to be fully enjoyed by consumers. For example, in case where the food product 48 is french fries, the condiment product 52 may be ketchup. In alternative embodiments, the container of the present invention can be used to contain beverages, such as coffee or tea, as the primary substance, and milk, sugar or other extracts or flavorings as the secondary substance. Cooking oil, shortening, spices, preservatives, flavorings, stabilizers, colorants, or other substances may also be included with the food product 48.

The container 100 preferably includes a substantially upright sidewall portion 10, formed of paperboard, paper, cardboard, plastic, or other foldable, moldable or deformable material. Acceptable results may be obtained, for example, using 15 or 18 point SBS (solid bleached sulfate) paperboard. The material(s) of construction used to form the sidewall portion 10 are selected to result in a container 100 that is substantially rigid (i.e., capable of supporting the weight of the container 100 and its contents in normal use by a consumer without undue deflection), and to provide economy and ease of fabrication. One or both of the interior and exterior faces of the sidewall portion 10 can comprise a coating, laminate, coextrusion or other treatment, such as for example polyethylene or other polymer(s), fluorocarbon treatment or wax, to provide a barrier against staining or absorption of oils, water or other liquids from the food product 48. As a representative example, a fluorocarbon treatment sold under the tradename FC807 by the 3M Company can be applied to the sidewall portion.

Figure 2:
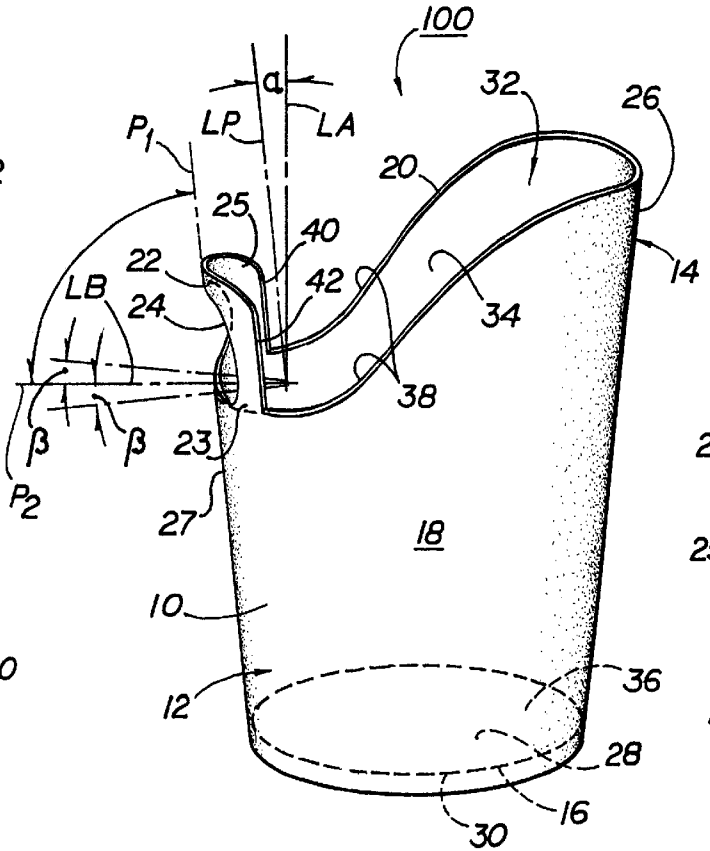
FIG. 2 is a side elevational perspective view of the container of the present invention shown in FIG. 1.
Figure 1:
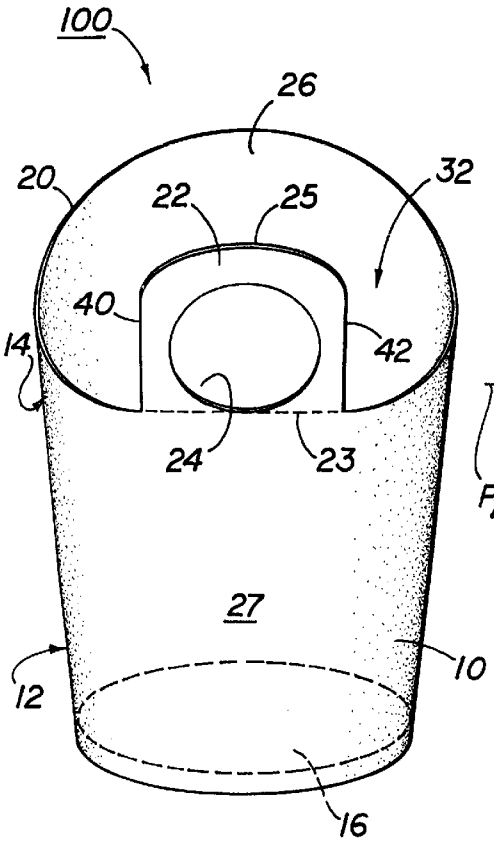
FIG. 1 is a front elevation perspective view of a container according to one embodiment of the present invention with the lip in its original position.

The sidewall portion 10 includes a back panel 26 and an opposing front panel 27 cooperating to each other to form a cavity 32. The cavity 32 has two ends 34, 36. A bottom portion 16 extends from the back panel 26 to the front panel 27. The bottom portion 16 has an interior face 28 and an exterior surface 30. The interior surface 28 of the bottom portion 16 closes the cavity 32 at one end 36 to define an interior volume 32 for receiving a primary substance such as the food product 48 therein. The back panel 26 and front panel 27 can be a single, curved wall panel or separate wall panels formed into a generally cylindrical or frustoconical container 100 as shown in FIGS. 1–3 or a container having other geometric shapes. Cross-sectionally, the container 100 can be substantially circular, elliptical, rectangular, square, etc. The sidewall portion 10 further includes a lower portion 12 at the lower edge of the sidewall 10. The upper portion 14 of the sidewall portion 10 comprises an open mouth 20 providing access to the interior volume 32 bounded by the sidewall portion 10 and therefore to the food product 48 contained therein. There is no mechanical cut-off line between the upper portion 14 and the lower portion 12. Nevertheless, in general, the lower portion 12 includes portions below the open mouth 20. The upper portion 14 and the lower portion 12 can seamlessly merge into a single, integral sidewall portion 10 as shown in FIGS. 1–3. Alternatively, the upper portion 14 and the lower portion 12 can be separate elements which are complementarity sized to fit each other to form the sidewall portion 10.

At least one lip 22 is utilized to provide a condiment holder for the container 100. Lip 22 is a flap extending upwardly from the front panel 27. Lip 22 has a proximal end 23 about which lip 22 is connected to the front panel 27 and foldable therealong and an opposed end 25. Lip 22 in FIG. 1 is at its original position $P_1$, which is substantially vertical or at an acute angle $\alpha$ from the vertical direction identified by an axis LA such as when the food container 10 is frusto-conical as shown in FIGS. 1–3. The relative orientation of $P_1$ to the axis LA can be identified by an axis LP, which is parallel to the orientation of $P_1$ as shown in FIG. 2. The axis LP is introduced here for illustration of the acute angle $\alpha$ between the axis LA and the position $P_1$. That is, the acute angle $\alpha$ between the axis LA and the axis LP represents the acute angle $\alpha$ between the axis LA and the position $P_1$. The degree of the acute angle $\alpha$ is variable and adjustable. However, in general, the degree of the acute angle is smaller than 90°. Lip 22 has an opening 24 sized to receive a separate, second or condiment container 50 containing the secondary substance 52. Opening 24 can have different types of geometric shape and/or sizes. For example, if the condiment container 50 is frusto-conical, opening 24 preferably is annular. Openings with other geometric shape, such as elliptical, square, rectangular, etc., are also workable. Lip 22 is foldable and can be folded from its original, substantially vertical position $P_1$ as best shown in FIG. 2 to its operative or second position $P_2$ ready to receive the condiment container 50 therein in the embodiment as best shown in FIG. 3. The position $P_2$ can be substantially horizontal or at an acute angle β either above or below from the horizontal position identified by an axis LB, where the axis LA and the axis LB are perpendicular to each other. At this position, portions of the condiment container 50 received in the opening it 24 can make contact with the corresponding parts of the sidewall portion 10 and be supported thereon, in addition to the support provided through the engagement of the lip 22 and the condiment container 50. In fact, the lip 22 at the second position $P_2$, the condiment container 50 received therein, and the sidewall portion 10 engage each other in a triangular relationship to offer a stable structure. This foldable characteristic of lip 22 allows it not to significantly affect the stacking of one container over another one. That is to say, prior to use, a plurality of containers 100 with lips 22 at their original, substantially vertical positions can be stacked together for easy storage, handling, and skipping. Lip 22 is juxtaposed to or an integral part of the sidewall portion 10 in the embodiment as shown in FIGS. 1–3. In this embodiment, as better seen in FIG. 2, the back panel 26 is seamlessly merged with the lip 22 along a top edge 38 concavely from both sides 40, 42 of the lip 22. In addition to its aesthetical appearance, the concavely-curved top edge 38 provides easy access to the volume 32 (and the food product 48 therein when in use) and prevents accidental scratch by the edges of the container to users hands. Alternatively, lip 22 can be a separate element and attached to, associated with or fixed to the sidewall portion 10 at a location according to the user's choice. For instance, lip 22 can be a separate piece of paperboard, paper, cardboard, plastic, or other foldable, moldable or deformable material having a sticky end that can be stuck to the sidewall portion 10. Moreover, more than one lip or a lip having more than one openings or multiple lips with multiple openings can be utilized to give the container 100 capacity to hold more than one condiment container.

Figure 6:
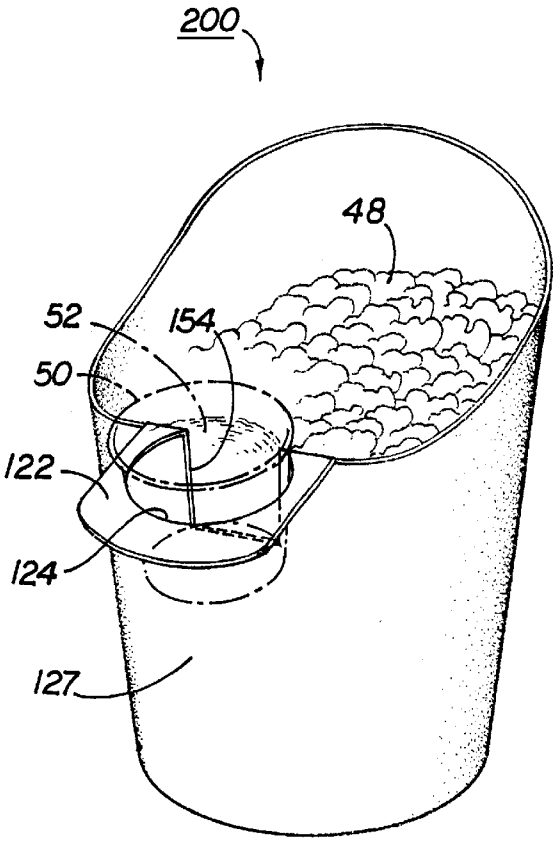
FIG. 6 is a perspective view of the container of the present invention shown in FIGS. 4 and 5 with the lip in its operative or second position to receive a condiment container therein, along with food product in the container.
Figure 5:
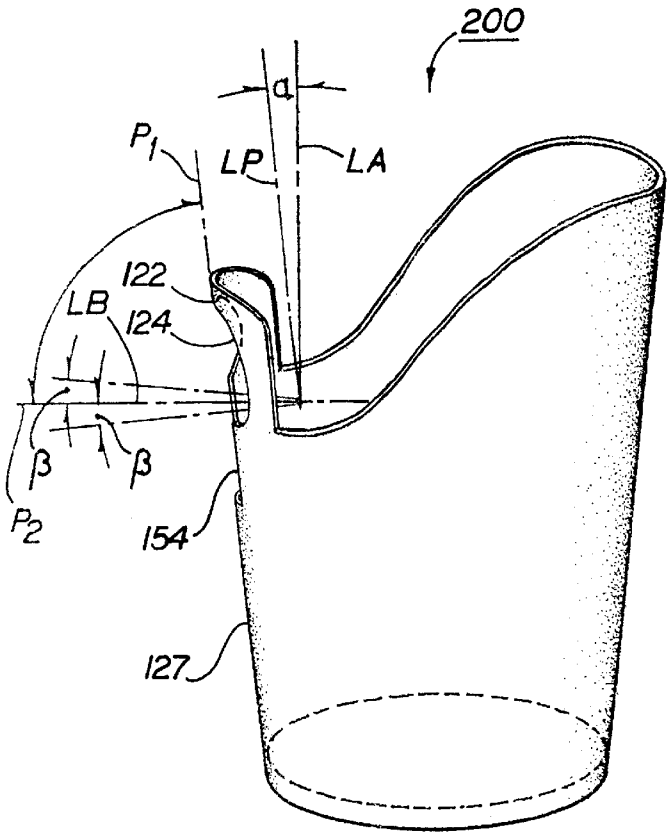
FIG. 5 is a side elevational perspective view of the container of the present invention shown in FIG. 4.
Figure 4:
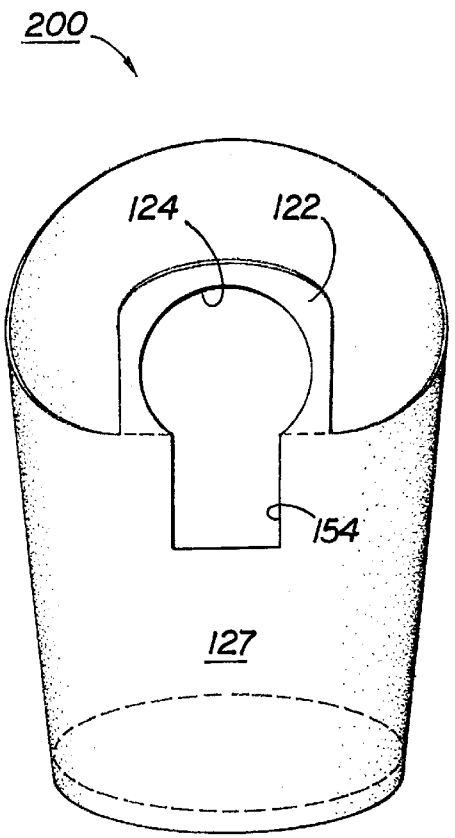
FIG. 4 is a front elevational perspective view of a container according to another embodiment of the present invention with the lip in its original position.

In a second example embodiment, described now with reference to FIGS. 4–6, the present invention in one aspect is related to a food container 200 for holding a primary substance such as a food product 48. The food container 200 is similar to the food container 100 as shown in FIGS. 1–3 except the food container 200 has a second opening 154 deposited at the lower portion of the front panel 127. The second opening 154 is in communication with a first opening 124 of a lip 122. The lip 122 extends upwardly from the lower portion of the front panel 127 in its original position, which is substantially vertical or at an acute α angle from the vertical direction identified by an axis LA as shown in FIGS. 4–6. Lip 122 is foldable and can be folded from its original, substantially vertical position $P_1$ as best shown in FIG. 5 to its operative or second position $P_2$ ready to receive the condiment container 50 as best shown in FIG. 6. The position $P_2$ can be substantially horizontal or at an acute angle β either above or below from the horizontal position identified by an axis LB, where the axis LA and the axis LB are perpendicular to each other. In the embodiment shown in FIG. 6, when the condiment container 50 is received in the first opening 124 of the lip 122, the body of the condiment container 50 can be partially received in the second opening 154 of the front panel 127 and supported therein. In the embodiment shown in FIGS. 4–6, the span of the second opening 154 can be sized smaller than the diameter of the condiment container 50 so that the condiment container 50 can be slightly pushed into the second opening 154 when the food container 200 is in use. This way, the condiment container 50 can be better supported by the front panel 127 from the sides and the bottom. Thus, manufacturing the food container 200 with a second opening deposited in its front panel as shown in FIGS. 4–6 may require slightly more labor cost than manufacturing the food container 100 as shown in FIGS. 1–3. Nevertheless, food container 200 can offer stronger support than a condiment container 100. Both embodiments offer viable food containers depending on a user's preference.

Figure 7:
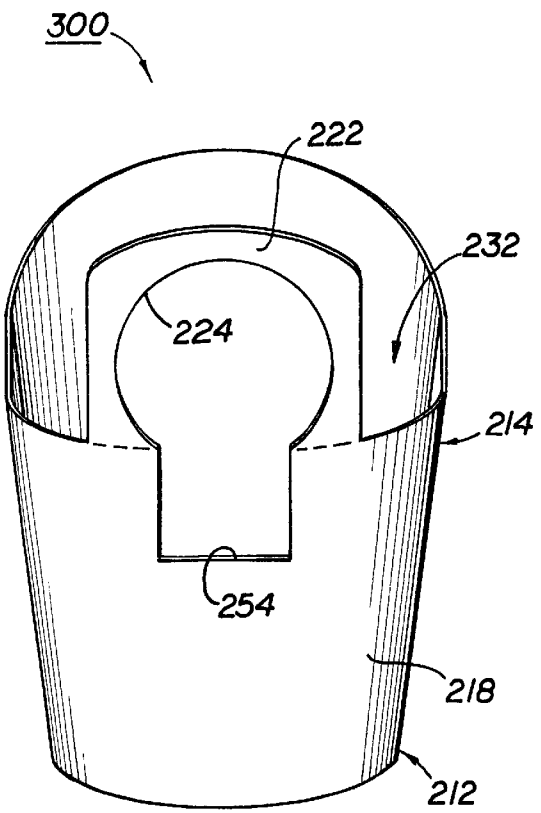
FIG. 7 is a front elevational perspective view of a container according to yet another embodiment of the invention with the lip in its original position.

In a third example embodiment, now described with reference to FIGS. 7–9, the present invention in one aspect is related to a food container 300 having a capacity for holding both a primary substance such as a food product 48 and a secondary substance 52. The food container 300 has a lower portion 212 and a upper portion 214. The lower portion 212 includes a bottom 216, a body 218 and a mouth 220. The body 218 is formed by at least one substantially upright sidewall 210. The upper portion 214 includes a lip 222 and an opposite back panel 226. The lip 222 extends upwardly from the mouth 220 of the lower portion 212. The lip 222 has an opening 224. The back panel 226, opposite the lip 222, also extends upwardly from the mouth 220 of the lower portion 212. The back panel 226 cooperates with the bottom 216 and body 218 of the lower portion 212 to define a volume 232 for receiving a primary substance such as french fries therein.

Figure 9:
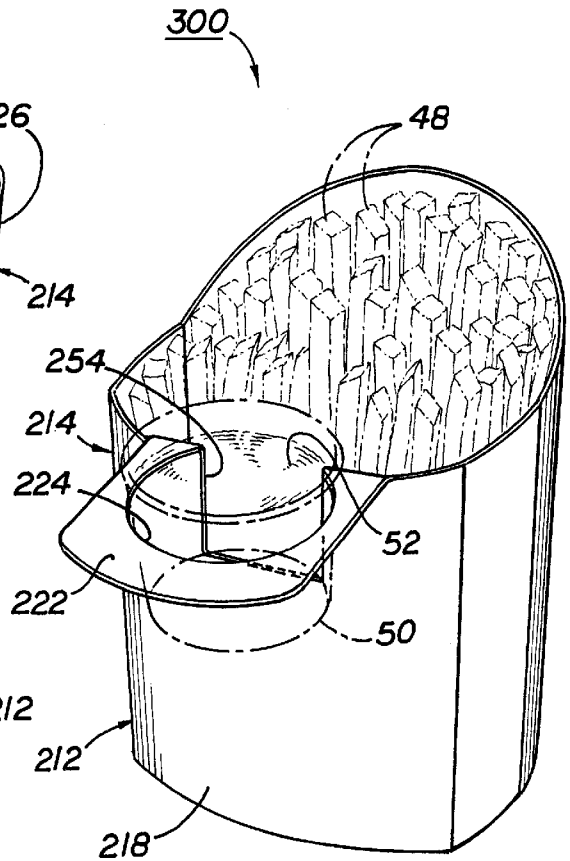
FIG. 9 is a perspective view of the container of the present invention shown in FIGS. 7 and 8 with the lip in its operative or second position to receive a condiment container therein, along with food product in the container.
Figure 8:
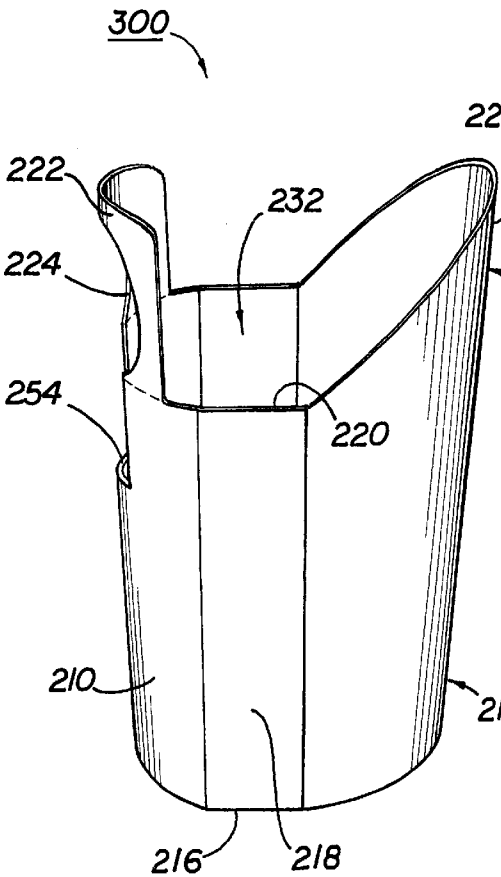
FIG. 8 is a side elevational perspective view of the container of the present invention shown in FIG. 7.

Similar to the embodiments shown in FIGS. 1–6, the lip 222 is foldable and can be folded from its original, substantially vertical position or at an acute angle α from the vertical direction $P_1$ as best shown in FIG. 8, to its operative or second position $P_2$ as best shown in FIG. 9 ready to receive the condiment container 50. The position $P_2$ can be substantially horizontal or at an acute angle β either above or below from the horizontal position. Optionally, the body 218 of the lower portion 212 has an opening 254 in communication with the opening 224 of the lip 222. This way, when the condiment container 50 is received in the opening 224 of the lip 222, the body of the condiment container 50 can be partially received in the opening 254 of the body 218 and supported therein by the body 218. In the embodiment as best shown in FIG. 7, the opening 224 of the lip 222 is substantially annular. It will be appreciated that when the body 218 of the lower portion 212 has the opening 254, the opening 224 is not a full circle, but substantially annular in part as best shown in FIG. 7. In the embodiment as shown in FIGS. 7–9, the opening 254 is substantially rectangular so that a cylindrical condiment container can be tightly received therein as shown in FIG. 9, for example. Alternatively, the geometrical shapes of the openings 224 and 254 can take other shapes as well to accommodate the condiment container and/or the needs of a user. For example, the openings 224 and 254 can be complementarity sized to form a circle when the lip 222 is at the first position $P_1$. Moreover, unlike the embodiments shown in FIGS. 1–6 where the food container has a frusto-conical body shape, the food container 300 is substantially quadrilateral cross-sectionally. Alternatively, the food container 300 can be rectangular, annular, elliptic, circular, or any other geometric shape cross-sectionally.

Containment of the primary food product 48 within the volume 32, 132 or 232 and the secondary substance 52 in a container received in the foldable holder formed by the lip 22, 122, or 222 in the manner of the present invention provides a number of advantages over known containers wherein the secondary substance 52 is contained in various surface structures and/or separate holders. Because the food container according to the present invention has a foldable condiment holder that is an integral and inherent part of the food container, it offers a cost-efficient and user-friendly food container.

As discussed above, food containers of the present invention can be formed with paperboard having a coating such as a hold-out type of coating. This coating can be polyethylene or other type of coating that can contain the primary food product, whether in solid or liquid form, inside the food container to prevent the paperboard from breaking down. Each food container can be formed with known technologies and processes in the art. For example, food containers can be formed with an online printing and coating process. The paperboard can be first printed and coated. Then the paperboard can be die cut flat, fed into a forming operation around a mandrel and sealed with a bottom to form a food container. The process can be automated to produce food containers one after another. The formed containers, each with a holder, can be stacked and cased.

Other embodiments may alternatively be devised. For example, food containers have a foldable lip with multiple openings to receive more than one condiment containers, are possible. Or, food containers have multiple foldable lips each having one or more openings to receive more than one condiment containers, are possible as well. Additionally, although the blanks used to form the food containers have generally been referred to paperboard blanks, other materials of fabrication are possible, such as for example, cardboard and card stock, paper, plastic sheeting, and other foldable, moldable or formable materials.

While the invention has been described in its preferred forms, it will be readily apparent to those of ordinary skill in the art that many additions, modifications and deletions can be made thereto without departing from the spirit and scope of the invention.

What is claimed is:

1. A food container comprising:

(a) a sidewall portion having:
  (i) a back panel,
  (ii) an opposing front panel cooperating with the back panel to form a cavity with two ends, and
  (iii) a lip having a distal end and a proximal end and extending upwardly from the front panel, the lip having an opening disposed intermediate the distal end and the proximal end; and (b) a bottom portion extending from the back panel to the front panel, the bottom portion having an interior face and an exterior face, the interior face of the bottom portion closing the cavity at one end to define an interior volume for receiving a primary substance therein.

2. The container of claim 1, wherein the lip is foldable outwardly about the proximal end to form a holder for receiving a secondary substance in the opening.

3. The container of claim 2, wherein the secondary substance is contained in a second container, the opening being sized to fit the second container.

4. The container of claim 3, wherein the secondary substance comprises a condiment.

5. The container of claim 2, wherein the opening of the lip is substantially annular.

6. The container of claim 1, wherein the sidewall portion is formed from a paperboard blank.

7. The container of claim 1, wherein the bottom portion is formed from a paperboard blank.

8. The container of claim 1, wherein the back panel comprises a curved top edge.

9. The container of claim 8, wherein the back panel is seamlessly merged with the lip along the top edge concavely from both sides of the lip.

10. A food container comprising:

(a) a sidewall forming a cavity with two ends, the sidewall having:
  (i) a back panel, and
  (ii) an opposing front panel having an opening;

(b) a lip having a distal end and a proximal end and extending upwardly from the front panel, the lip having an opening in communication with the opening of the front panel wherein the opening of the lip is disposed intermediate the distal end and the proximal end; and (c) a bottom closing the cavity at one end to define a volume for receiving a primary substance therein.

11. The container of claim 10, wherein the lip is foldable about the proximal end outwardly from the sidewall to form a holder for receiving a secondary substance in the opening of the lip.

12. The container of claim 11, wherein the secondary substance is contained in a second container, the opening of the lip being sized to fit to the second container.

13. The container of claim 12, wherein the second container is partially received in the opening of the front panel of the sidewall and supported therein.

14. The container of claim 10, wherein the opening of the lip is substantially annular in part, and the opening of the front panel of the sidewall is substantially rectangular.

15. The container of claim 10, wherein the back panel comprises a curved top edge.

16. The container of claim 15, wherein the curved top edge has a center portion and two ends, the top edge extending from the center portion concavely to each of the two ends.

17. A food container comprising:

(a) a lower portion having:
  (i) a bottom,
  (ii) a body formed by at least one substantially upright sidewall, and
  (iii) a mouth; and (b) a upper portion having:
  (i) a lip having a distal end and a proximal end and extending upwardly from the mouth of the lower portion, the lip having an opening disposed intermediate the distal end and the proximal end; and
  (ii) an opposite back panel extending upwarding from the mouth of the lower portion, wherein the back panel cooperates with the body and bottom of the lower portion to define a volume for receiving a primary substance therein.

18. The container of claim 17, wherein the lip is foldable about the proximal end outwardly to form a holder for receiving a secondary substance in the opening of the lip.

19. The container of claim 17, wherein the body of the lower portion has an opening in communication with the opening of the lip.

20. The container of claim 17, wherein the volume for receiving a primary substance is substantially annular cross-sectionally.

21. The container of claim 17, wherein the volume for receiving a primary substance is substantially quadrilateral cross-sectionally.

22. The container of claim 17, wherein the opening of the lip is substantially annular.

* * * * *